United States Patent [19]

Van Wagener et al.

[11] 4,105,196

[45] Aug. 8, 1978

[54] SHEET COLLATOR DEVICE

[75] Inventors: Raymond H. Van Wagener, Darien, Conn.; Ernest M. Raasch, Fort Lee, N.J.; Elsio J. Loos, Bronx, N.Y.

[73] Assignee: Swingline Inc., Long Island, N.Y.

[21] Appl. No.: 656,263

[22] Filed: Feb. 9, 1976

Related U.S. Application Data

[63] Continuation-in-part of Ser. No. 548,471, Feb. 10, 1975, abandoned.

[51] Int. Cl.[2] ..... B65H 39/05

[52] U.S. Cl. ..... 270/58

[58] Field of Search ..... 270/58; 271/21-23

[56] References Cited

U.S. PATENT DOCUMENTS

| | | | |
|---|---|---|---|
| 469,366 | 2/1892 | Sedgwick | 271/21 |
| 2,449,594 | 9/1948 | Druliner | 270/58 |
| 2,770,456 | 11/1956 | Magarinos | 270/58 |
| 3,059,920 | 10/1962 | Denny | 270/58 |
| 3,269,721 | 8/1966 | Taylor | 270/58 |
| 3,350,089 | 10/1967 | Niccoli | 270/58 |
| 3,664,656 | 5/1972 | Ryland | 270/58 |

*Primary Examiner*—Edgar S. Burr
*Assistant Examiner*—A. Heinz
*Attorney, Agent, or Firm*—Pennie & Edmonds

[57] ABSTRACT

A unit having a plurality of bins for holding inclined stacks of sheets to be collated having a reciprocating arrangement supported by the unit which arrangement includes rigid push rods for pushing simultaneously one sheet from the top of each stack of sheets. The push rods and bin construction are so arranged that the frictional pads on the rod ends do not engage the bin surface when the bin is empty. A portion of the reciprocating arrangement may be tilted to permit lifting the push rod ends to the upper region of the bins to facilitate loading.

9 Claims, 22 Drawing Figures

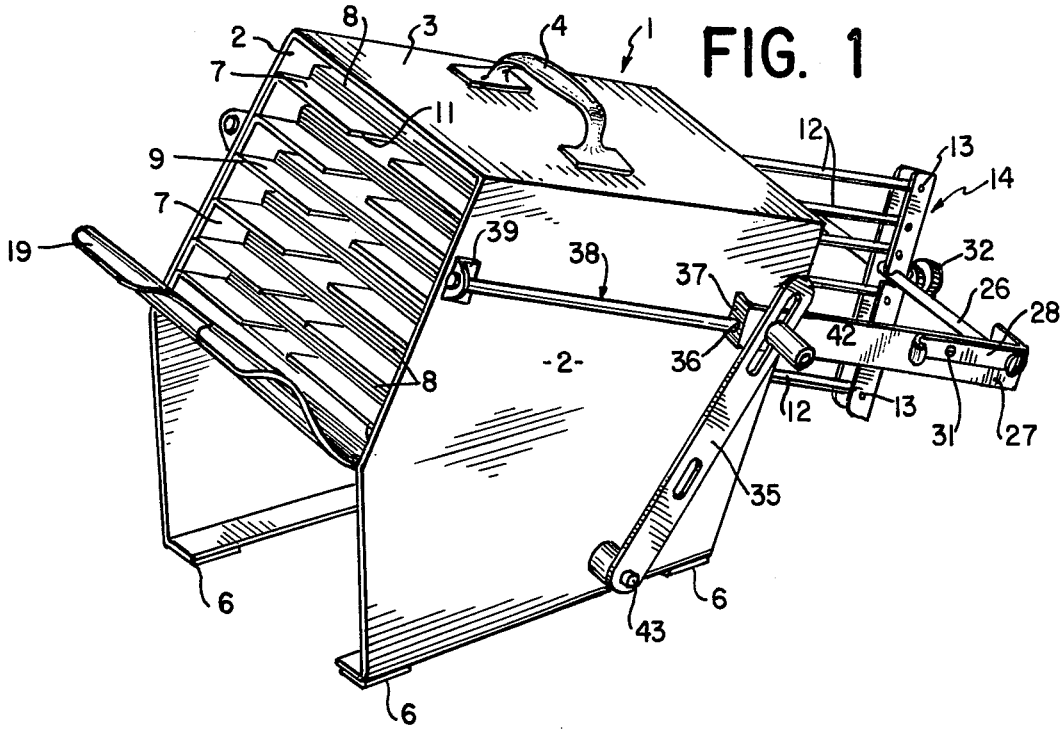
FIG. 1
FIG. 2
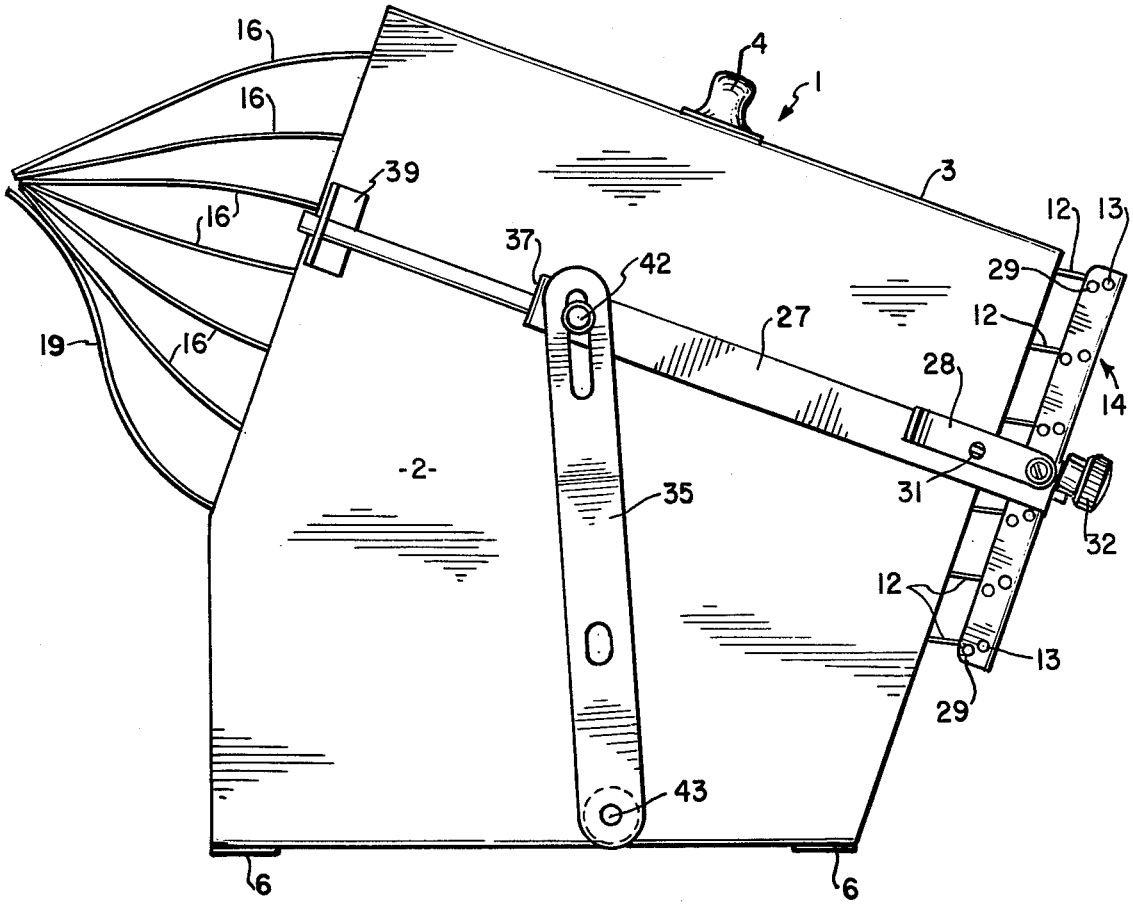

SHEET COLLATOR DEVICE

CROSS REFERENCE TO RELATED APPLICATION

This application is a continuation-in-part of our earlier filed application Ser. No. 548,471, filed Feb. 10, 1975, now abandoned.

BACKGROUND OF THE INVENTION

Sheet collators operable through reciprocation of a set of pusher elements connected to a reciprocal carriage are known in the art: Kalish U.S. Pat. No. 2,885,203; Thomas U.S. Pat. No. 2,399,584; and Hernblad U.S. Pat. No. 2,599,829. Inclined bin collators are also known: Thomas U.S. Pat. No. 2,829,888. However, the failure of prior collators has included difficult loading, excessive pusher pad wear and lack of compactness.

The present collator provides a unique pusher arrangement which accomplishes collation under circumstances where prior units would fail.

SUMMARY OF THE INVENTION

Broadly, the present invention is a collator having a set of rigid pusher rods pivotally attached to a reciprocating frame arrangement for accomplishing movement of the pusher rods in predetermined paths. The pusher rods are free to pivot in a vertical plane in a direction downwardly toward the support surface of the bins and are capable of being rotated in the opposite direction to hold them in an elevated lift position for loading of stacks of sheets to be collated without rod interference.

It is also a feature that the push rod pads ride on the top sheets in each bin or ride within a groove in a support surface of a bin when the bin is empty, thus avoiding wear of the pad when it is not being utilized in the operation of the unit.

An alternative embodiment of the invention is provided with means for facilitating the feeding of smooth surfaced stock. Sheets of such paper tend to cling after resting in a stack for a period of time. The clinging problem is substantially relieved by curling the top sheet in the stack, thereby introducing a layer of air between the top sheet and the stack prior to feeding of the top sheet. This layer of air acts as a lubricant which prevents the papers from clinging to each other.

BRIEF DESCRIPTION OF THE DRAWINGS

FIG. 1 is a perspective view of the unit;

FIG. 2 is a side elevational view of the unit;

DETAILED DESCRIPTION OF THE PREFERRED EMBODIMENT

Figures 3, 4, 5:
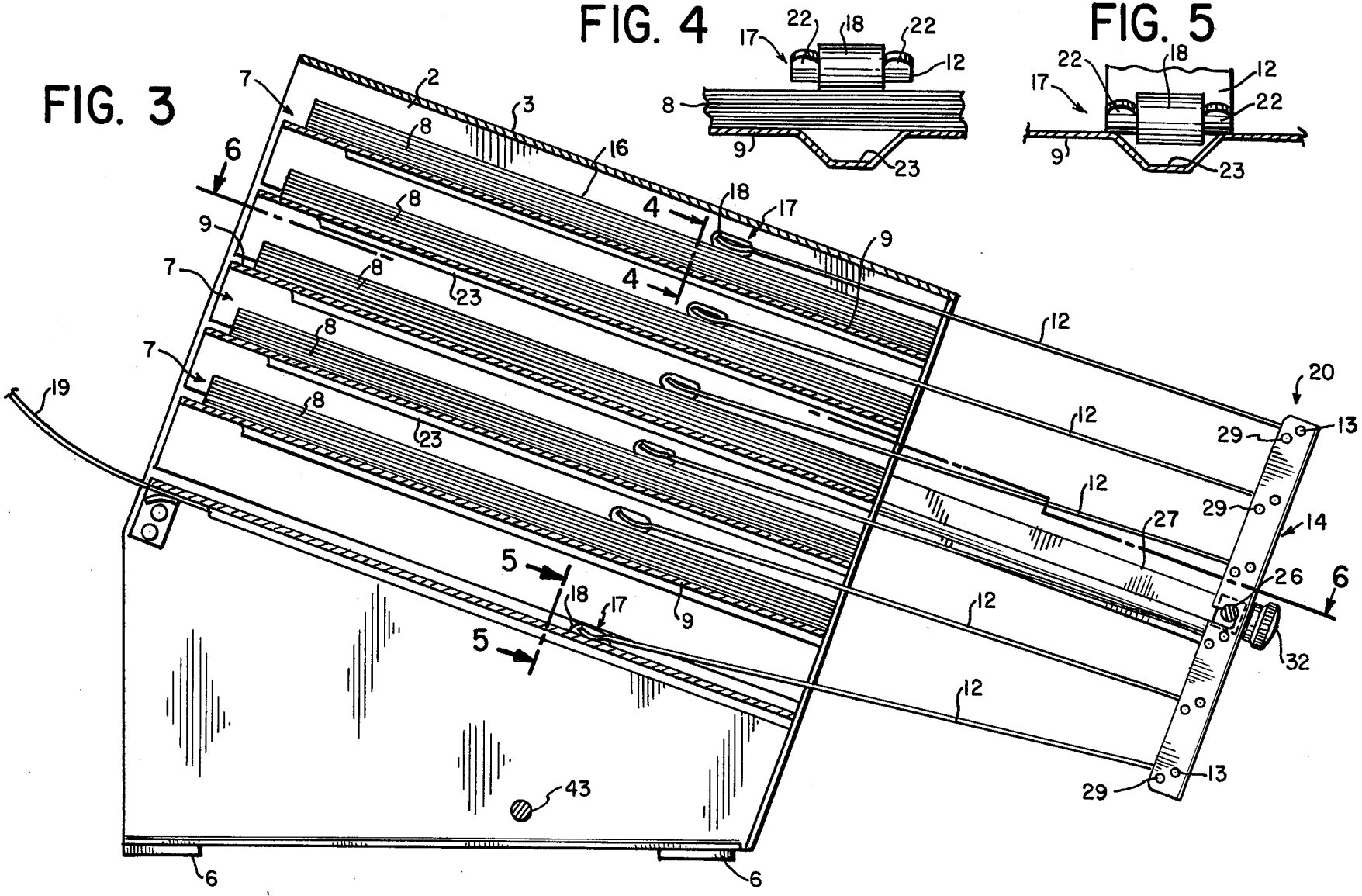
FIG. 3 is an enlarged sectional side elevational view of the unit.
FIG. 4 is a sectional view along line 4—4 of FIG. 3.
FIG. 5 is a sectional view along line 5—5 of FIG. 3.

Referring to FIGS. 1-6, the collator unit 1 includes vertical side panels 2, inclined top 3, carrying handle 4 and feet 6. For illustrative purposes, in FIG. 3 five bins 7 have a stack of sheets in them while the lowest bin is shown empty. Bins 7 include bottoms 9 for supporting stacks 8. Bottoms 9 have cutout recesses 11 at their central upper ends to facilitate removal of stacks or sheets from the bins.

Turning to FIG. 3, rigid reciprocating pusher rods 12 are free to pivot about pivot pins 13 on pusher frame 14 in the counter-clockwise direction as shown in FIG. 3. Prior to movement of pusher frame 14, the force of gravity is the only force causing the ends 17 of pusher rods 12 to engage either a stack of sheets or a bottom 9 of an empty bin. Each pusher rod end 17 has a frictional pad 18 on its end which engages the top sheet 16 to push the sheet up and partially out of the upper end of bin 7. Unit extension 19 serves to support the partially removed sheets 16 until removed by hand.

Pads 18 may be made of rubber, plastic or other frictional material which will engage and apply sufficient force to sheets 16 to cause them to move off the top of the stacks 8. The inclination of stacks 8 serves to increase the force required by rods 12 and discourages the second from the top sheet moving with the top sheet 16.

Figure 6:
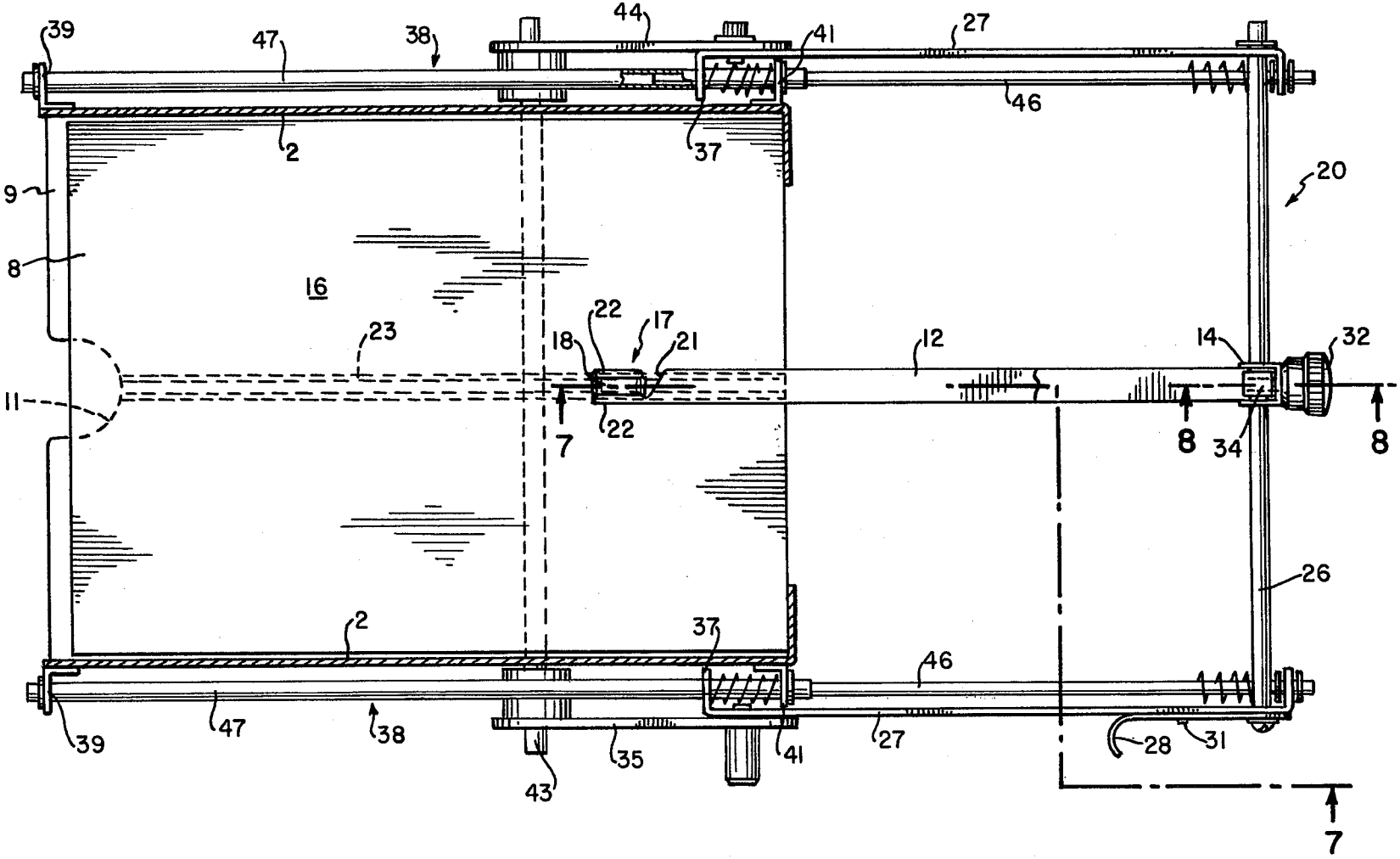
FIG. 6 is a sectional view along line 6—6 of FIG. 3.
Figure 7A:
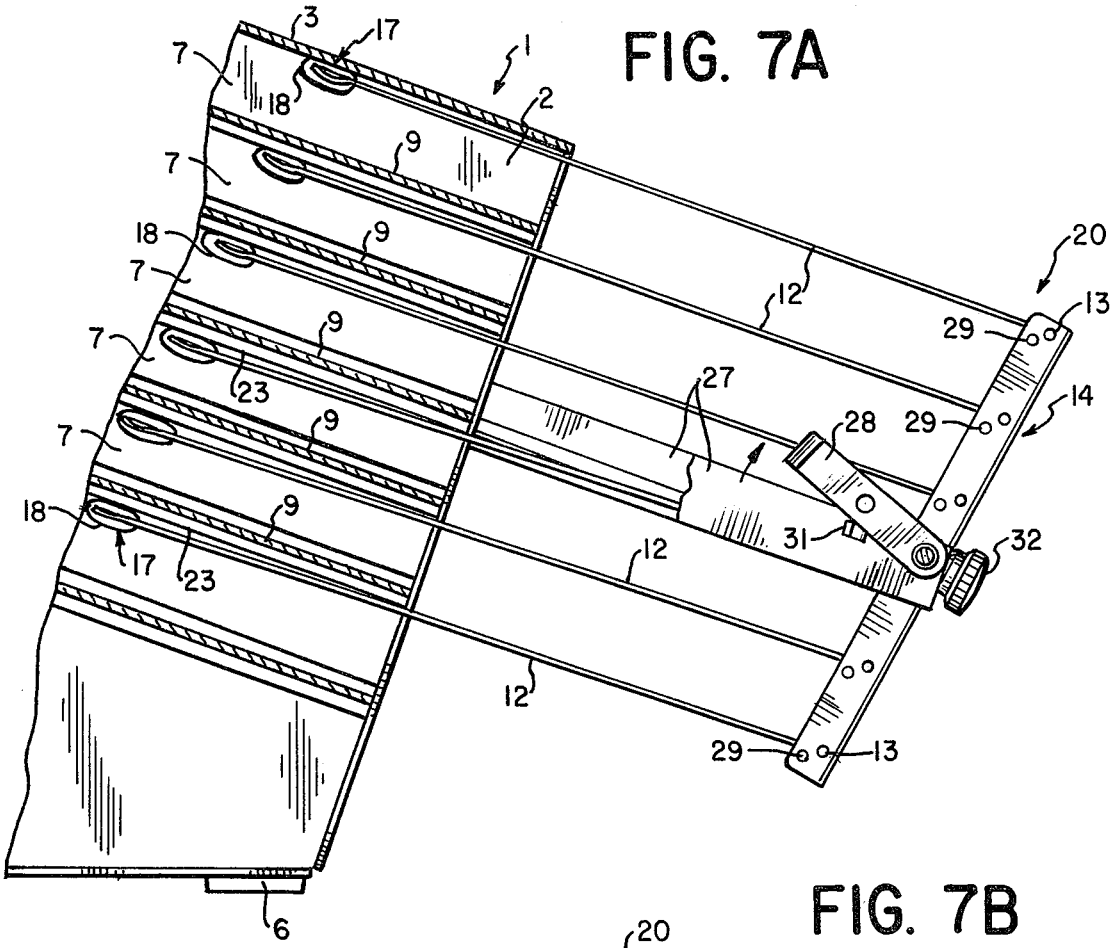
FIG. 7A is a sectional view along line 7—7 of FIG. 6.

Referring to FIGS. 5, 6 and 7A, pusher rod 12 has a notched area 21 near its end 17 and two raised longitudinal ribs 22 to accommodate and hold against lateral movement pad 18 which in this embodiment is in the form of a band of rubber or other elastic material which is sized to be stretched, placed on the end 17 and held by the contractive force of the band. FIG. 5 illustrates that the pad does not ride on the stack support bin bottom 9 when a bin is empty. The low-frictional metal longitudinal ribs 22 instead ride on the surface with the pad being accommodated by a groove 23 in bottom 9 (see FIG. 5). With reference to FIG. 3, the pusher rods 12 are freely pivoted about pins 13 on pusher frame 14 so that the weight of the rods 12 together with the movement of the rods serve without other added forces to apply, through pads 18, the needed forces for collation.

It is important that rods 12 have sufficient weight. If the rods do not weigh enough, they will ride over the top of the stacks of paper sheets without advancing the top sheet. On the other hand, if the weight of the rods is too heavy, more than one sheet at a time will be advanced.

Figure 7B:
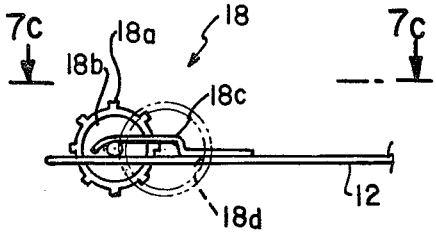
FIG. 7B is a side view of an alternative embodiment of a pad constructed in accordance with the present invention.
Figure 7C:
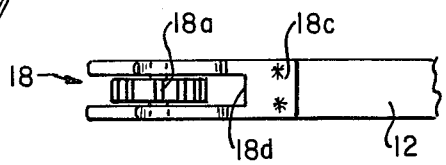
FIG. 7C is a view along line 7C—7C of FIG. 7B.

Although a number of structures may be utilized in the construction of pads 18, a particularly advantageous pad is illustrated in FIGS. 7B and 7C. This pad 18 comprises a notched rubber band 18*a* mounted on a wheel 18*b*. Rubber band 18*a* is notched in order to give it better gripping properties. Wheel 18*b* is axially mounted and supported for rotation and lateral displacement by support 18*c*. During forward movement of rod 12, wheel 18*b* of pad 18 moves to the rear of slot 18*d* in rod 12. This causes it to bear against the rear portion of slot 18*d* and thus prevents it from rotating. This position is shown in phantom lines in FIG. 7B. During the return of rod 12 to its rearward position, pad 18 is laterally displaced to the position shown in solid lines in FIG. 7B in which it is allowed to rotate freely as it passes over the top surface of the stack of sheets. This prevents rubber band 18*a* from becoming fouled with paper fibers as a result of its rubbing over the stack of sheets on its return to its rearward position.

Figure 7D:
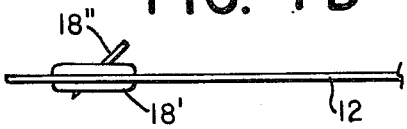
FIG. 7D is a side view of yet another embodiment of a pad constructed in accordance with the present invention.

An alternative pad is illustrated in FIG. 7D. This structure comprises a support 18' mounted on rod 12. Mounted in support 18' is a pin 18'' which takes the place of the rubber band in the pads illustrated in the other embodiments.

Figure 8:
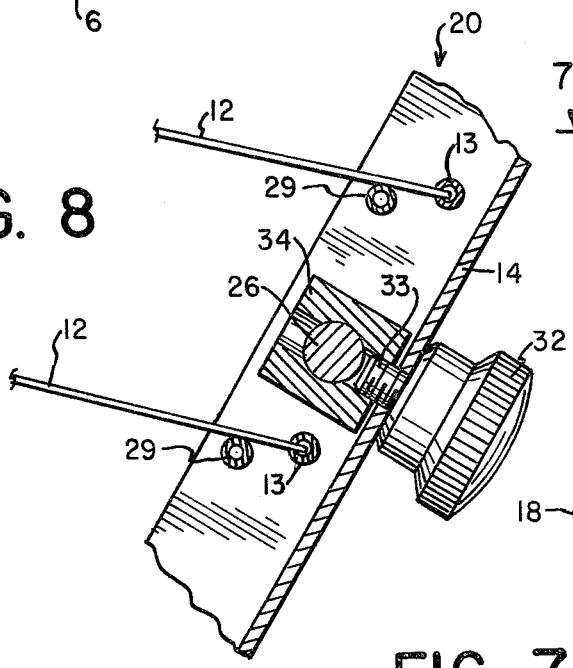
FIG. 8 is a sectional view along line 8—8 of FIG. 6.

In FIGS. 6 and 7A, the pusher frame 14 is shown affixed to horizontal rocker rod 26 which in turn is pivotably movable in side frame pieces 27 so that rod 26 may be rotated clockwise as shown in FIG. 7A by turning flexible lever 28 to cause lifting pins 29 on frame 14 (FIG. 8) to engage the rigid pusher rods 12 and lift them until the rod ends 17 are raised up into the upper portions of bins 7. Lever 28 may be locked on top of detent 31 (FIG. 7A) to hold the rods 12 in their raised position. The loading of bins is facilitated by this lift feature.

Referring again to FIG. 8, nob 32 having threaded stem 33, together with threaded element 34 surrounding rocker rod 26, provides a technique for the ready removal of the pusher frame unit 20, which includes frame 14 and attached rods 12, from its mount on rod 26. With the removal of frame unit 20, the pusher rods 12 are brought out of the bins into the open where pusher rods 12 and their pads 18 can be replaced as required.

In FIGS. 1 and 6, the construction of the mechanism for reciprocating pusher frame unit 20 is best seen. Side frame pieces 27 have holes 36 in their ends 37 to receive telescopic rod sets 38. The telescopic rod sets 38 also pass through upper and lower brackets 39 and 41 attached to side panels 2 of the unit. Handle 42 on side piece 27 moves arm 35 which in turn is secured to lower axle 43. As handle 42 is moved to the left, as seen in FIG. 1, frame 14 is moved in the same direction to push sheets 16 upwardly. When handle 42 is moved to the right, the carriage arrangement is returned to a position ready for further operation. Motion from handle 42 is also transferred through axle 43 to arm 44 on the other side of the unit (see FIG. 6) thus applying an equal force to both sides of the reciprocating carriage. Smaller rod 46 telescopes into larger rod 47 to avoid rod movement past the front or discharge end of the bins. This telescopic technique contributes to the compactness of the unit.

Figure 9:
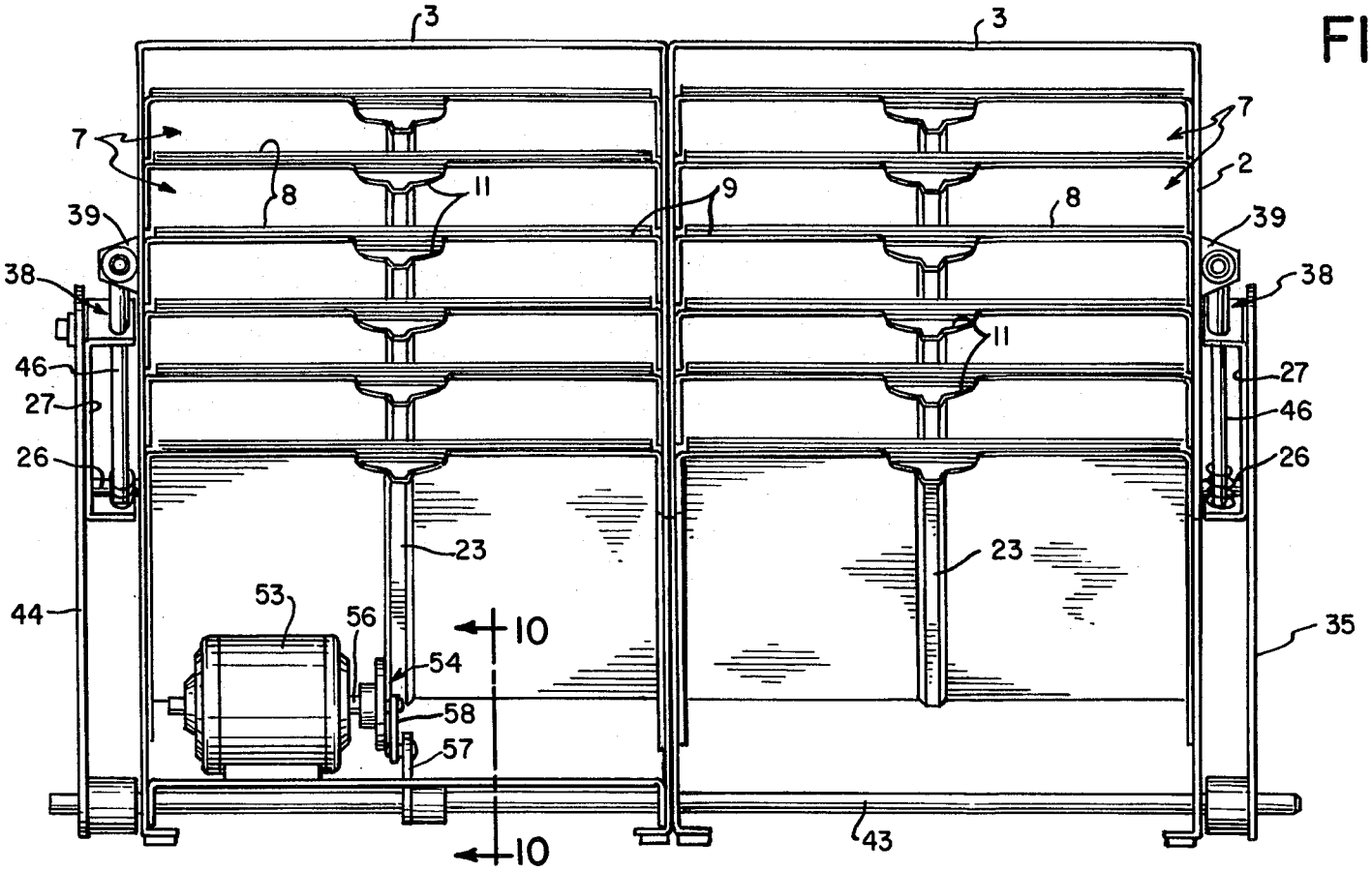
FIG. 9 is an end elevational view of a double capacity device including a power drive arrangement.
Figure 10:
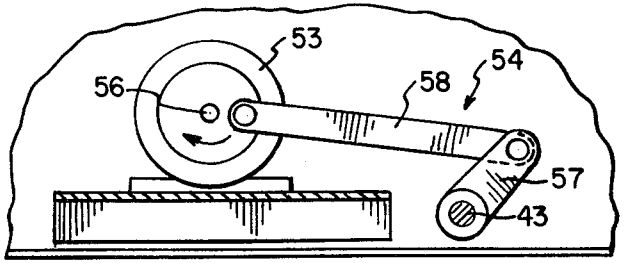
FIG. 10 is a sectional view of line 10—10 of FIG. 9.
Figure 11:
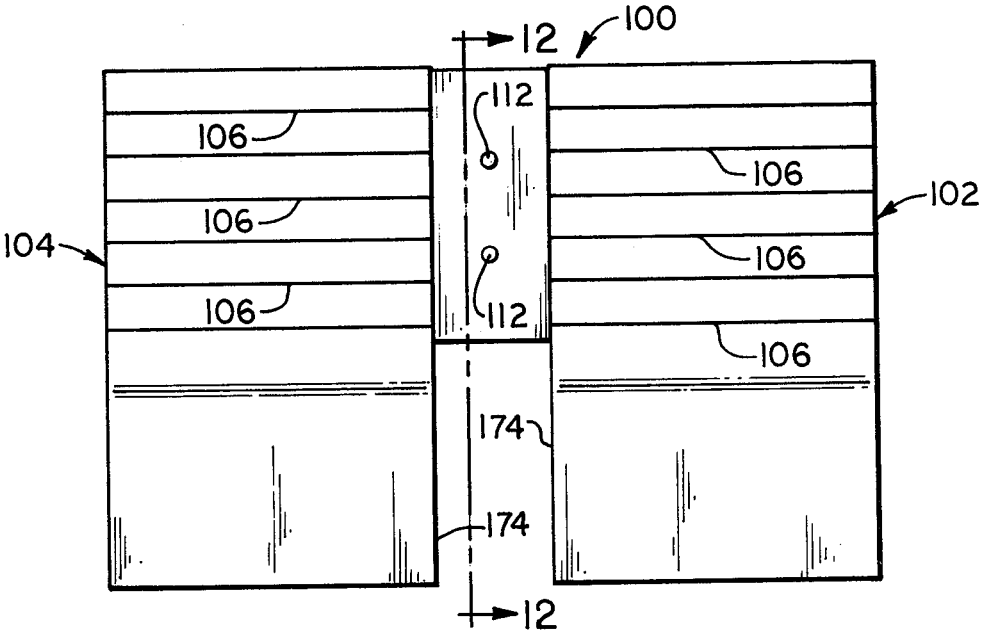
FIG. 11 is a front view of a two-section collator incorporating structure for insuring the uniform feeding of papers which tend to cling to each other.

Referring to FIGS. 9 and 10, a double capacity unit is shown comprising two separate units in side-by-side relationship. This unit includes a common axle 43. This collator is automatically driven by a motor 53. Motor 53 has a crank assembly 54 to convert the constant rotary motion of motor drive wheel 56 to the required rocking motion for collation. Such conversion is performed by a rockable axle crank 57 which is secured to axle 43 and is moved back and forth by linkage rod 58. This results in reciprocating rotary motion of axle 43 which in turn drives arms 35 and 44, a common horizontal rocker rod 26 and pusher rods (not shown). The pusher rods include pads which may take any of a number of forms such as the embodiments illustrated in FIGS. 7B–C.

In the case of papers which have very smooth surfaces, such as coated stock and other high gloss papers, there is a tendency for adjacent pages to cling to each other during the collator's feeding operation. It has been found that the clinging may be reduced by separating the pages from each other prior to feeding. It has been further discovered that if each page is individually separated from the stack just before it is fed by the collator, clinging is substantially eliminated. This is a consequence of the fact that such a separating operation results in the introduction of a layer of air between the top sheet, which is about to be fed, and the next subadjacent sheet. This layer of air acts as a lubricant and thus facilitates the feeding of only the top sheet.

An embodiment of the invention including structure for relieving clinging during the feeding of smooth surfaced papers is illustrated in FIGS. 11–18. The collator 100 comprises first and second sections 102 and 104. Sections 102 and 104 include a number of shelves 106. Referring in particular to FIGS. 12–17, feeding is accomplished by the reciprocal motion of lever 108 between the position illustrated in solid lines and phantom lines in FIG. 12. As lever 108 moves back and forth, it moves finger assembly 110, to which it is coupled via slot 107 and pin 107', in a reciprocal motion on rails 112 which are slidingly engaged by assembly 110. As assembly 110 moves back and forth a plurality of fingers 111 associated with it also move back and forth thus resulting in the forward advancement of the top sheet of paper on each shelf 106 as lever 108 moves from the position illustrated in solid lines to the position illustrated in phantom lines. Fingers 111 extend through slots 109 in the sidewall of sections 102 and 104. The sheets are gripped by rubber elements 114. Rubber elements 114 have concave bottom surfaces 116 which facilitate gripping and are mounted in gimbel fashion on flexible rubber posts 118. Posts 118 are integral with elements 114, and by allowing them two degrees of angular freedom, allow the rubber elements 114, regardless of the height of the stack, to move into planar engagement with the top sheet of each stack.

The reciprocal movement of lever 108 drives connecting links 120 and 122. Link 120 is pivotally connected to lever 108 and link 122 at pivot points 121. Link 122 is pivotally mounted at a fixed point 123. This results in the reciprocal movement of the end 124 of link 122 in the directions indicated by arrow 126.

End 124 includes a slot 128. A bar 130 (FIG. 13), mounted in slot 128 and secured via a pair of feet 132 to backplate 134, responds to the reciprocal movement of end 124, thus moving down from the position illustrated in FIG. 13, through the position illustrated in FIG. 14 and into the position illustrated in FIG. 15A. Plate 134 is slidably mounted for reciprocal up and down motion on supports 135 which extend through slots 137. Plate 134 has a plurality of pins 136 mounted thereon. Pins 136 serve as cam followers, engaging surface 138 on cams 140. Cams 140 are secured to bars 142 which in turn are rotatably mounted in brackets 144. Brackets 144 are connected via a rivet 146 to a leaf spring 148. Cams 140 are urged into the position illustrated in FIG. 13 by a plurality of springs 150. Also secured to bars 142 are a plurality of wheels 152 which are provided with serrated surfaces 154. It is thus seen that angular rotation of one of the cams 140 will result in angular rotation of its associated wheel 152.

Figure 12:
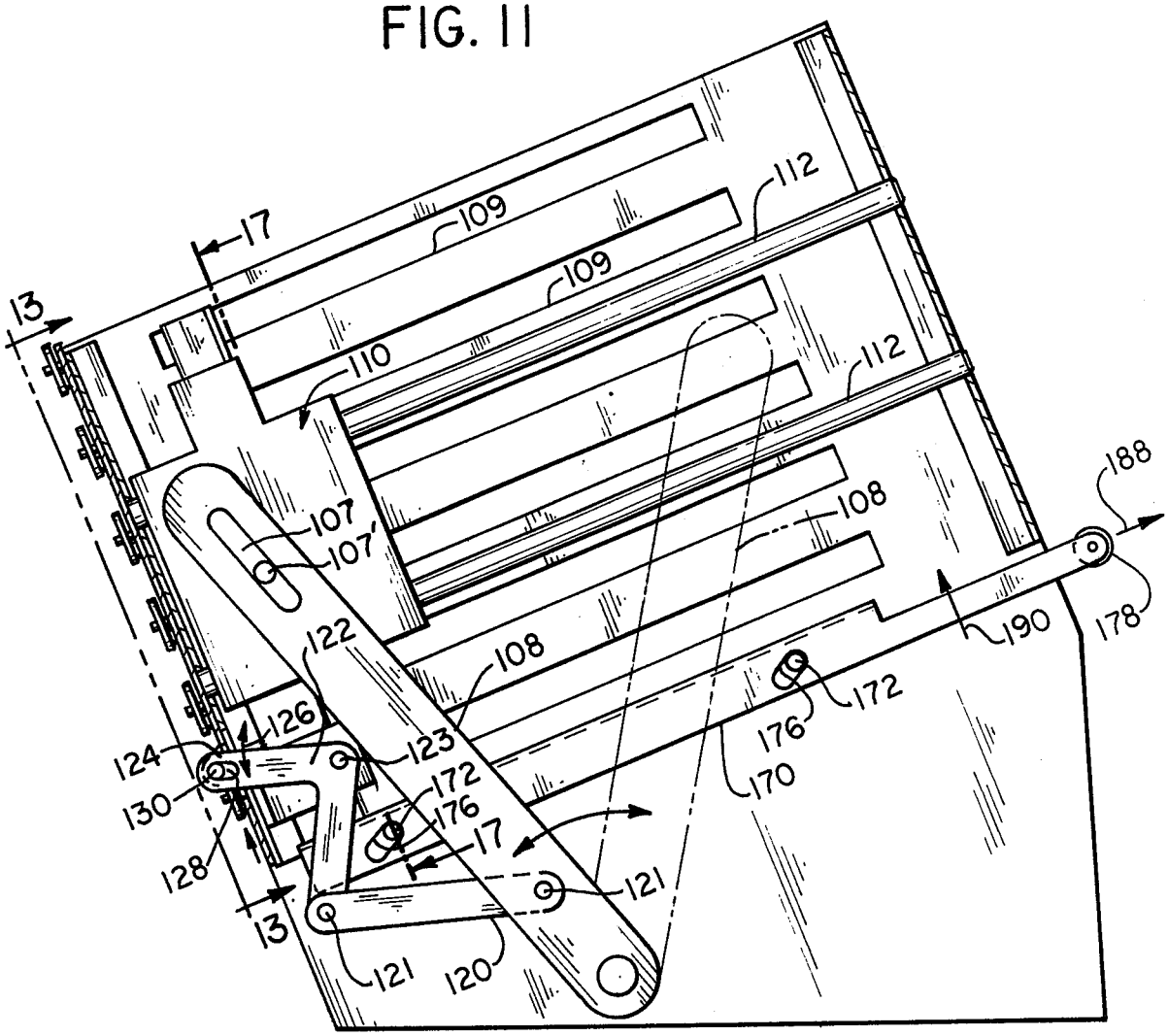
FIG. 12 is a cross-sectional view along line 12—12 of FIG. 11.
Figure 13:
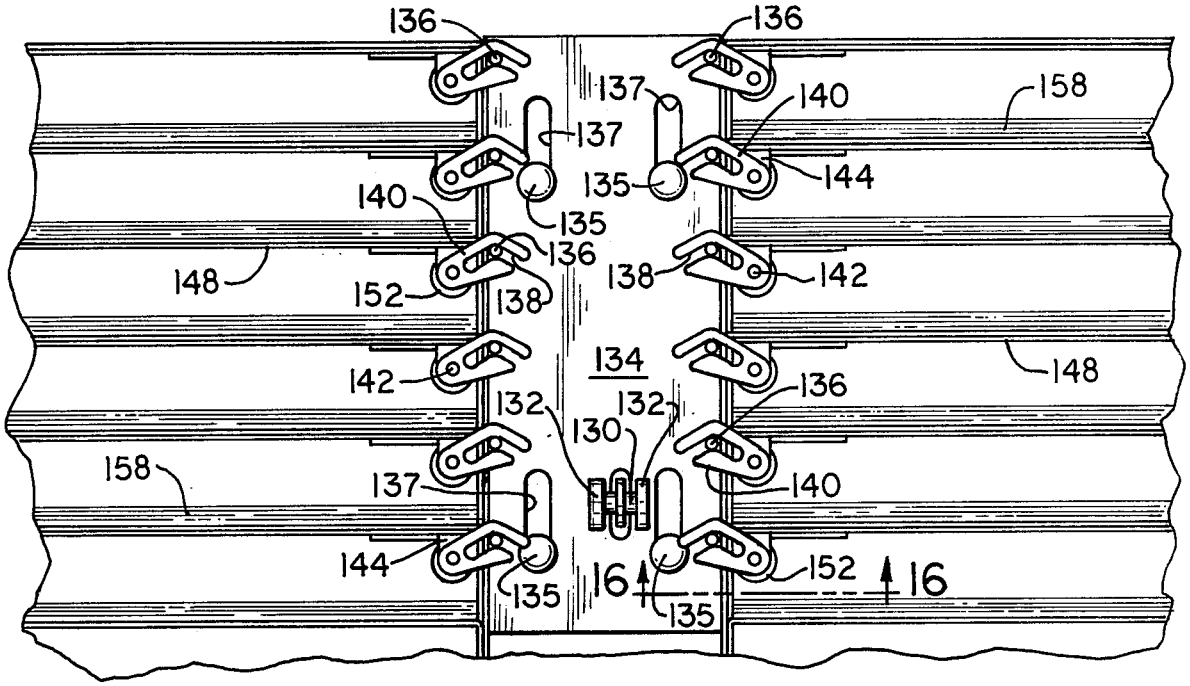
FIG. 13 is a cross-sectional view along line 13—13 of FIG. 12.
Figure 14:
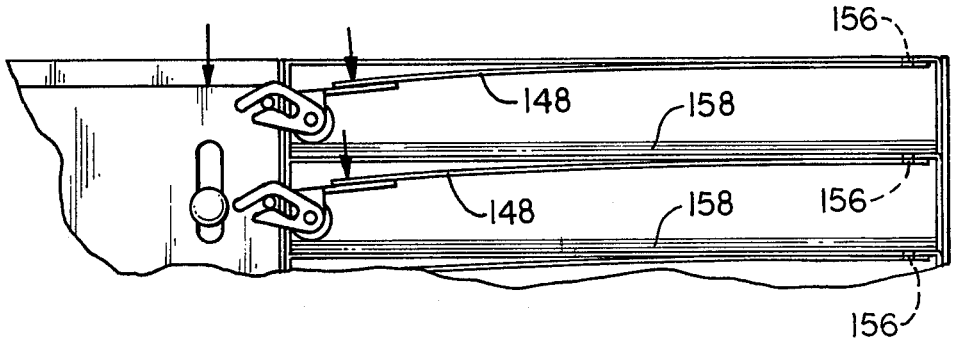
FIGS. 14 and 15A are views of a portion of the apparatus illustrated in FIG. 13 during successive steps in the operation of the collator.

During operation, reciprocal movement of lever 108 from the position illustrated in solid lines to the position illustrated in phantom lines results in the advancement of fingers 111 toward the front of the collator 100 and a corresponding advancement of the top sheet on the stack. After the top sheet has been advanced a distance, the movement of lever 108 has caused the lowering of end 124 of link 122. This causes the lowering of plate 134 from the position illustrated in FIG. 13 to the position illustrated in FIG. 14. FIG. 13 represents the position of the plate when lever 108 is in the position illustrated in solid lines in FIG. 12 and FIG. 14 represents the position of the plate when lever 108 is in a position intermediate the position illustrated in solid lines and the position illustrated in phantom lines. In this intermediate position, the serrated surface 154 of wheel 152 has been brought into engagement with the sheet underneath the sheet being fed because the sheet being fed has already been advanced the said distance from underneath wheel 152. It is noted that in the advancement of plate 134 from the position illustrated in FIG. 13 to the position illustrated in FIG. 14 there has been substantially no rotational movement of cams 140 with respect to brackets 144. This is so because each coil spring 150 is very stiff compared to its associated leaf spring 148. Thus, initially, downward movement of plate 134 and pins 136 results only in the flexure of leaf springs 148 which are secured at their opposite ends by rivets 156 and the resultant advancement of wheels 152 toward stacks of paper 158.

Figure 15A:
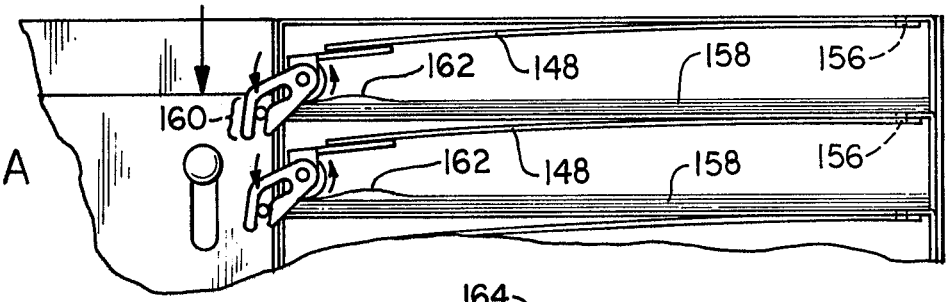
Figure 16:
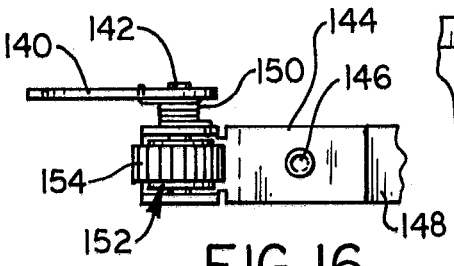
FIG. 16 is a detail along line 16—16 of FIG. 13 showing the construction of a portion of the structure which effects separation of the sheets to prevent them from clinging.

In the position illustrated in FIG. 14, wheels 152 are just in engagement with stacks of paper 158. At this point they can no longer move downwardly. However, plate 134 along with pins 136 continues to move downwardly to the position illustrated in FIG. 15A. This causes pins 136 to follow surface 138 of cams 140 resulting in rotation of the cams about rods 142 and rotation of wheels 152. Most of the rotation of cams 140 occurs as pins 136 move from the position illustrated in FIG. 13 into the straight portion 160 of surface 138. Dependent upon the height of the stack of sheets 158, the position of plate 134 which corresponds to rotation of wheel 152 will vary. However, because substantially all rotation of wheel 152 occurs prior to entry of pin 136 into straight portion 160, the angular rotation of wheel 152 remains substantially uniform. Rotation of wheel 152 after its engagement with the top remaining sheet of paper 162, after the top sheet has been fed forward by the action of fingers 111, results in the curling of sheet 162 as illustrated most clearly in FIG. 15A. This curling cooperates with the natural curl of the paper and is thus particularly effective in introducing a blanket of air between the top remaining sheet and the stack. The natural curl results from the fact that paper is usually cut from continuous rolls that impart a curl to the paper. FIG. 15A illustrates the position of plate 134 when lever 108 is between the position illustrated in phantom lines in FIG. 12 and the position that it is in when the collator is in the position illustrated in FIG. 13. As noted above, this curling action has the desirable effect of separating the top remaining sheet from the stack and introducing a blanket of air between the top remaining sheet and the remaining sheets in the stack. This blanket serves as a lubricant and facilitates the removal of the top remaining sheet during the next feeding cycle.

Figure 15B:
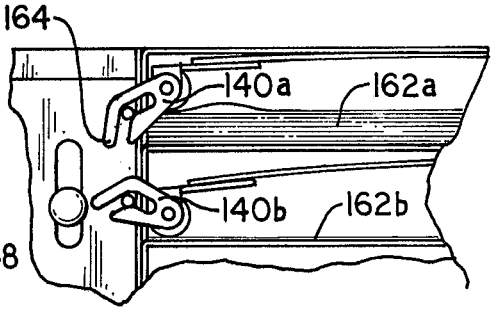
FIG. 15B illustrates the operation of the collator when feeding stacks of different height.
Figure 17:
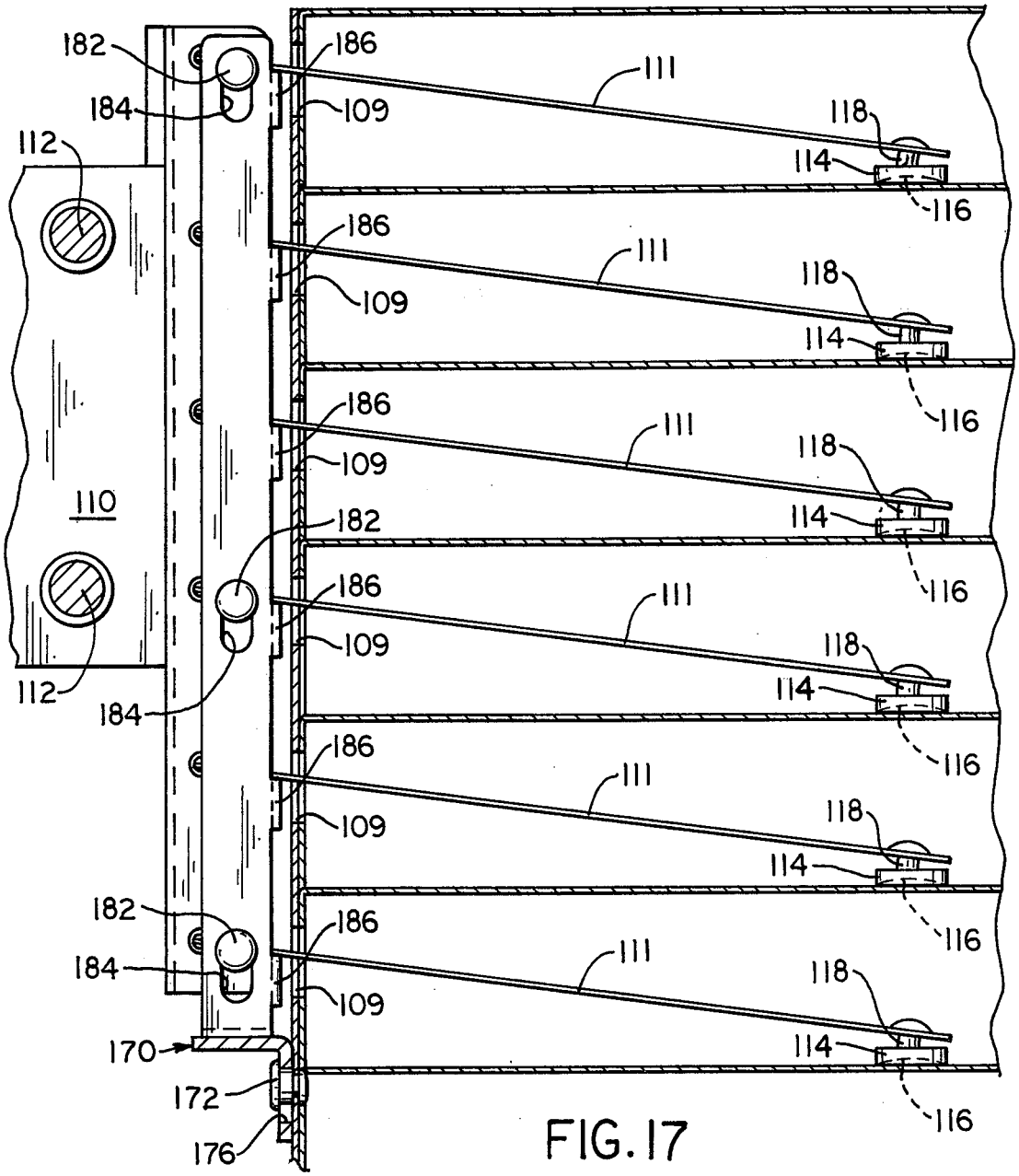
FIG. 17 is a cross-sectional view along line 17—17 of FIG. 12.

In the design of cams 140 it is important that the ends 164 of the cams are short enough to prevent clashing with adjacent cams during feeding of paper from stack of different size as is illustrated in FIG. 15B. In thi figure stack **162*a* is higher than stack 162*b*. This results in a situation where cam 140*b* remains in the position illustrated in FIG. 13. However, because of the shape of cams 140*a* and 140*b***, they operate independently, not touching or interfering with each other.

Referring to FIG. 12, an operator arm 170 is slidably mounted on bars 172 which in turn are secured to the sidewalls 174 of sections 102 and 104. Bars 172 extend through slots 176 which are disposed in oblique relation to operator arm 170. Operator arm 170 includes pulling handle 178. The other end of arm 170 supports vertical member 180. Vertical member 180 is slidably mounted for reciprocal up and down motion on pins 182 which extend through slots 184. Pins 182 are mounted on finger assembly 110.

Figure 18:
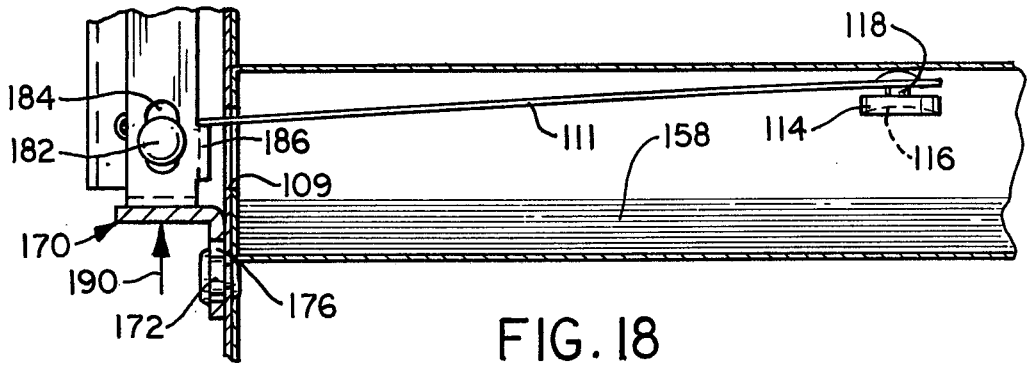
FIG. 18 is a view of a portion of the apparatus illustrated in FIG. 17 when the machine is in the loading position.

Member 180 includes a number of studs 186. These studs are so positioned that their upper surfaces abut fingers 111 when arm 170 is in the position illustrated in FIG. 12. If one pulls handle 178 in the direction indicated by arrow 188, arm 170 will rise in the direction indicated by arrow 190. This causes member 180 to rise, carrying studs 186 upward and lifting fingers 111 out from engagement with a stack of sheets 158 as illustrated in FIG. 18. This allows the removal of a stack of sheets from a bin or the loading of sheets into the bin.

While a number of embodiments have been illustrated, it is understood that various changes and modifications will be obvious to those skilled in the art and that these changes and modifications are within the spirit and scope of the invention as limited only by the appended claims.

We claim:

1. A collator comprising:

(a) a main housing including at least two bins, each of said bins adapted to receive a stack of sheets;

(b) a reciprocating member mounted on said housing for reciprocating movement;

(c) a finger associated with each of said bins and coupled to said reciprocating member for reciprocating movement therewith, each of said fingers being positioned to engage the top sheet of a stack of sheets placed in its associated bin and to move said top sheet from said bin in response to reciprocating movement of said member;

(d) a bracket associated with each of said bins and positioned with respect to said main housing for displacement toward and away from the top sheet on a stack of sheets placed within its associated bin;

(e) first biasing means for biasing each of said brackets toward a position removed from said stack of sheets;

(f) engagement means mounted on each of said brackets for curling the top sheet of a stack upon engagement therewith;

(g) operator means coupled to all of said engagement means for moving said engagement means to curl top sheets;

(h) second biasing means for biasing said engagement means toward a first position with respect to said brackets, said first biasing means being weaker than and yielding before said second biasing means when said first and second biasing means are subjected to a force by the displacement of said operator means;

(i) means for applying a reciprocating motion to said operator means to cause said displacement of said brackets and said operator means;

(j) initial displacement of said brackets and its associated engagement means bringing said engagement means into engagement with a stack of sheets in its associated bin;

(k) further displacement resulting in movement of said operator and said engagement means with respect to said brackets for separating said top sheet from said stack by curling said top sheet.

2. A collator as in claim 1, wherein said first biasing means is a leaf spring and said brackets is mounted on said leaf spring.

3. A collator as in claim 2, wherein said engagement means is a wheel rotatably mounted on said bracket, said wheel being provided with a gripping peripheral surface and wherein said second biasing means is a coil spring which bears against said bracket and said engagement means.

4. A collator as in claim 3, wherein said means for applying a reciprocating motion to said operator means comprises linkage means coupling said operator means to said member.

5. A collator comprising:

(a) a main housing including at least two bins each of which is adapted to receive a stack of sheets for collation with at least one additional stack of sheets;

(b) a reciprocating member mounted on said housing for reciprocating movement;

(c) a finger for each of said bins coupled to said reciprocating member for reciprocating motion of said fingers relative to its associate bin;

(d) each of said fingers being positioned to engage the top sheet of a stack of sheets in a bin for moving said top sheet from its bin in response to reciprocating movement of said reciprocating member;

(e) curling means spaced from said fingers for separating the top sheet remaining on a stack by moving one portion relative to a remaining portion of the top sheet in a direction normal to said reciprocating motion to curl said top sheet and thereby introducing a lubricating blanket of air between the top sheet and the remainder of the stack, and (f) means interconnecting said curling means and said fingers for insuring that said curling means curls the top sheet remaining on a stack prior to the beginning of the movement of said top sheet outwardly of its bin by its associated finger.

6. The collator of claim 5 in which said interconnecting means insures that said curling means curls the top sheet remaining on a stack subsequent to the beginning of the movement of the preceding top sheet on said stack outwardly of its bin by its associated finger.

7. The collator of claim 6 in which said interconnecting means insures that said curling means curls the top sheet remaining on a stack prior to completion of the movement of the preceding top sheet outwardly of its bin by its associated finger.

8. The collator of claim 5 in which said curling means includes a rotatable wheel mounted on an axis substantially parallel to the direction of reciprocating movement of said reciprocating member and said fingers whereby the curl produced in the top sheet by said curling means extends transversely of the direction of said reciprocating movement.

9. A collator according to claim 5 in which said curling means includes a wheel mounted for rotation about an axis, said wheel also being mounted for movement toward and away from the top sheet on a stack of sheets and means for moving said wheel into engagement with said top sheet prior to rotation of said wheel.

* * * * *